US009664476B1

(12) United States Patent
Robinson et al.

(10) Patent No.: US 9,664,476 B1
(45) Date of Patent: May 30, 2017

(54) ADJUSTABLE FIREARM STOCK

(71) Applicant: RMDI, LLC, North Salt Lake, UT (US)

(72) Inventors: Alexander J. Robinson, Salt Lake City, UT (US); Eric Randall Keeney, North Salt Lake, UT (US)

(73) Assignee: RMDI, LLC, North Salt Lake, UT (US)

( * ) Notice: Subject to any disclaimer, the term of this patent is extended or adjusted under 35 U.S.C. 154(b) by 0 days.

(21) Appl. No.: 15/245,147

(22) Filed: Aug. 23, 2016

(51) Int. Cl.
*F41C 23/14* (2006.01)
*F41C 23/04* (2006.01)
*F41C 23/20* (2006.01)

(52) U.S. Cl.
CPC ..... *F41C 23/04* (2013.01); *F41C 23/20* (2013.01)

(58) Field of Classification Search
CPC ..... F41C 23/14; F41C 23/04; F41C 23/00; F41C 23/20; F41A 11/00; F41A 11/02; F41A 11/04
USPC ..... 42/75.01, 75.03, 71.01, 73, 72
See application file for complete search history.

(56) References Cited

U.S. PATENT DOCUMENTS 7,398,616 B1 * 7/2008 Weir ..... F41C 23/04 42/71.01
7,596,900 B2 10/2009 Robinson et al.
7,762,018 B1 * 7/2010 Fitzpatrick ..... F41A 11/02 42/73
7,793,453 B1 * 9/2010 Sewell, Jr. ..... F41C 23/04 42/73
7,866,078 B1 1/2011 Beretta
(Continued)

FOREIGN PATENT DOCUMENTS

EP 2636983 9/2013

OTHER PUBLICATIONS

English translation of the abstract of EP2636983. Sep. 11, 2013.

*Primary Examiner* — Derrick Morgan
(74) *Attorney, Agent, or Firm* — Richard K. C. Chang, II

(57) ABSTRACT

An adjustable stock for a firearm includes a fixed body attachable to the firearm and a moveable body slideably connected to the fixed body. The moveable body defines a butt of the stock. A hole may be defined in one of the fixed body and the moveable body that has a first side opening and a second side opening disposed opposite the first side opening. A position selector is disposed in the hole and includes a first selector body and a second selector body. The first selector body includes a body portion shaped as a button having an engagement surface and a protrusion extending away from the body portion. The second selector body includes a body portion shaped as a button having an engagement surface and a protrusion extending away from the body portion. A biasing device is disposed between the first and second selector bodies to bias the first and second selector bodies apart and so that the engagement surface of the first selector body extends from the first side opening and the engagement surface of the second selector body extends from the second side opening. Further, a plurality of locating slots is defined in the other of the fixed body and the moveable body. At least one of the protrusions of the first and second selector bodies engage one of the plurality of locating slots to selectively fix the relative position of the moveable body to the fixed body.

17 Claims, 5 Drawing Sheets

(56) References Cited

U.S. PATENT DOCUMENTS 7,937,873 B2 * 5/2011 Keng ..... F41C 23/04 42/71.01
8,453,365 B1 * 6/2013 Ballard ..... F41C 23/14 42/71.01
8,631,601 B2 * 1/2014 Langevin ..... F41C 23/04 42/73
8,943,947 B2 * 2/2015 Gomez ..... F41A 5/18 42/1.06
8,950,099 B2 * 2/2015 Rogers ..... F41C 23/04 42/71.01
8,984,790 B2 3/2015 Wilson et al.
9,291,414 B2 * 3/2016 Gomez ..... F41A 5/18
9,404,708 B1 * 8/2016 Chow ..... F41C 23/14
9,464,863 B2 * 10/2016 Mather ..... F41C 23/14
9,551,549 B1 * 1/2017 Chvala ..... F41C 23/14
2002/0050088 A1 * 5/2002 Sharp ..... F41A 23/10 42/73
2003/0192223 A1 * 10/2003 Sharp ..... F41A 23/10 42/94
2007/0261284 A1 * 11/2007 Keng ..... F41C 23/04 42/73
2009/0288324 A1 * 11/2009 Peterson ..... F41A 11/02 42/75.03
2011/0283584 A1 * 11/2011 Walters ..... F41C 23/04 42/73
2012/0000109 A1 * 1/2012 Zusman ..... F41C 23/14 42/71.01
2013/0097911 A1 * 4/2013 Larue ..... F41C 23/04 42/73
2014/0259848 A1 * 9/2014 Chvala ..... F41C 23/14 42/73
2014/0260946 A1 * 9/2014 Gomez ..... F41A 5/18 89/191.01
2015/0052795 A1 * 2/2015 Burke ..... F41C 23/14 42/71.01
2015/0184971 A1 * 7/2015 Liu ..... F41B 5/1403 124/25
2015/0276343 A1 * 10/2015 Zusman ..... F41C 23/04 42/71.01
2015/0338186 A1 * 11/2015 Hopkins ..... F41C 23/14 42/73
2016/0084612 A1 * 3/2016 Robinson ..... F41C 23/04 42/73
2016/0116249 A1 * 4/2016 Maugham ..... F41C 23/08 42/74
2016/0153744 A1 * 6/2016 Teetzel ..... F41C 27/06 42/105
2016/0187099 A1 * 6/2016 Cottle ..... F41C 23/14 42/73
2016/0202016 A1 * 7/2016 Mather ..... F41C 23/14 42/73
2016/0305738 A1 * 10/2016 Huang ..... F41C 23/04
2017/0023328 A1 * 1/2017 Irvin ..... F41C 23/04

* cited by examiner

ADJUSTABLE FIREARM STOCK

BACKGROUND

Several adjustable firearm stocks are currently available that allow a user to support a firearm. However, currently available adjustable stocks may be include slop and interfere with a user's repeatable sighting through the optics or sights of a firearm. Other adjustable stock designs use the adjustment devices that are difficult to manipulate while the firearm is shouldered. In spite of the different stocks available, there is still a need for new stock designs that better fit a user's body and shooting stance.

SUMMARY

In the preferred embodiment of the present invention, an adjustable stock for a firearm, an adjustable stock for a firearm includes a fixed body attachable to the firearm and a moveable body slideably connected to the fixed body. The moveable body defining a butt of the stock. A hole may be defined in one of the fixed body and the moveable body that has a first side opening and a second side opening disposed opposite the first side opening. A position selector is disposed in the hole and includes a first selector body and a second selector body. The first selector body includes a body portion shaped as a button having an engagement surface and a protrusion extending away from the body portion. The second selector body includes a body portion shaped as a button having an engagement surface and a protrusion extending away from the body portion. A biasing device is disposed between the first and second selector bodies to bias the first and second selector bodies apart and so that the engagement surface of the first selector body extends from the first side opening and the engagement surface of the second selector body extends from the second side opening. Further, a plurality of locating slots is defined in the other of the fixed body and the moveable body. At least one of the protrusions of the first and second selector bodies engage one of the plurality of locating slots to selectively fix the relative position of the moveable body to the fixed body.

DETAILED DESCRIPTION

Figure 1:
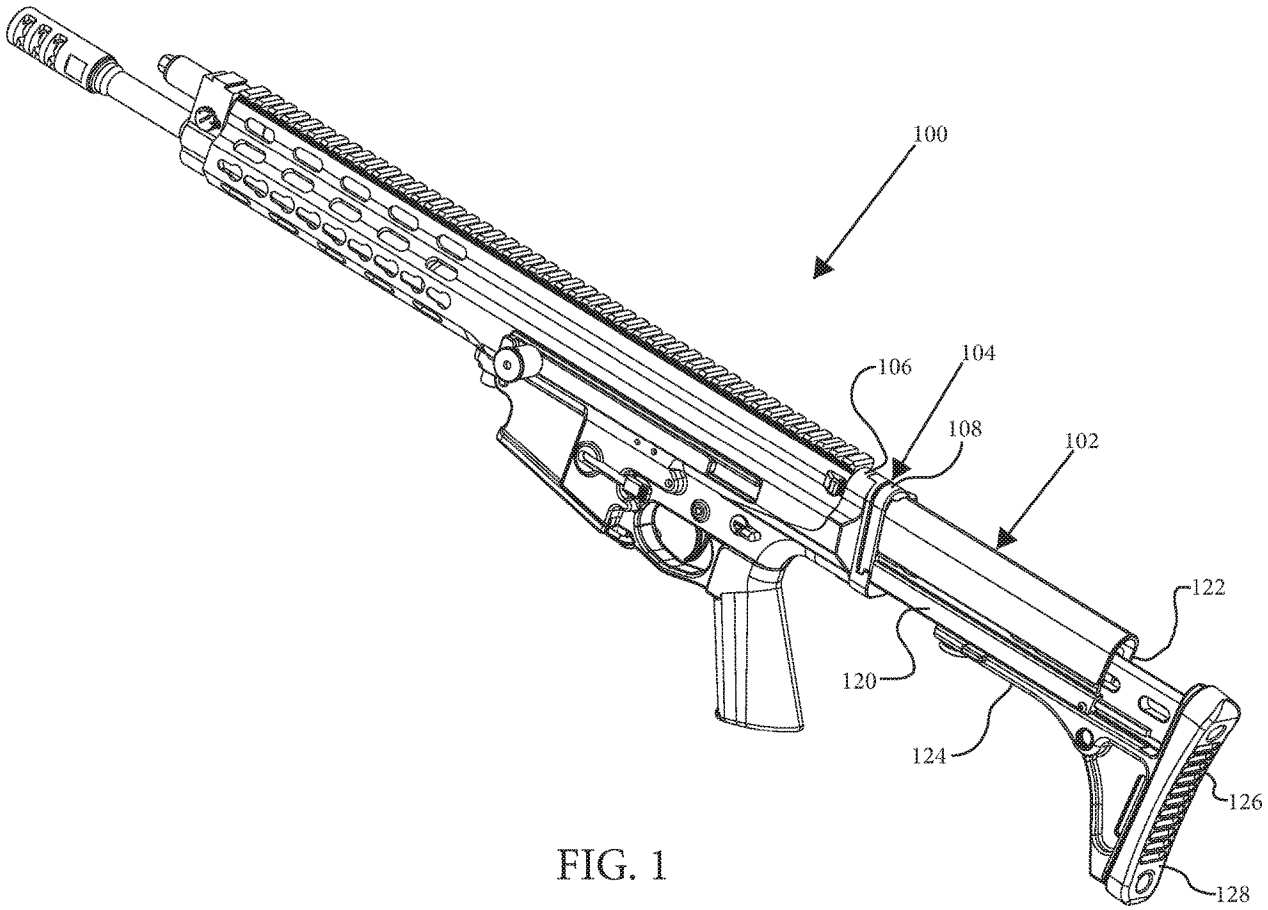
FIG. 1 illustrates a firearm having an adjustable stock.

FIG. 1 illustrates a firearm 100 with an attached adjustable stock 102. The stock 102 is attached to the firearm 100 by an attachment mount 104. In this embodiment, the optional attachment mount 104 permits the stock 102 to be folded against the firearm 100. As shown, the attachment mount 104 includes a firearm attachment plate 106 pivotally attached to a stock attachment plate 108.

The stock 102 has a first side 120 opposite the second side 122 and bottom side 124. A rear side 126 of the stock 102 defines the butt 128.

Figure 2:
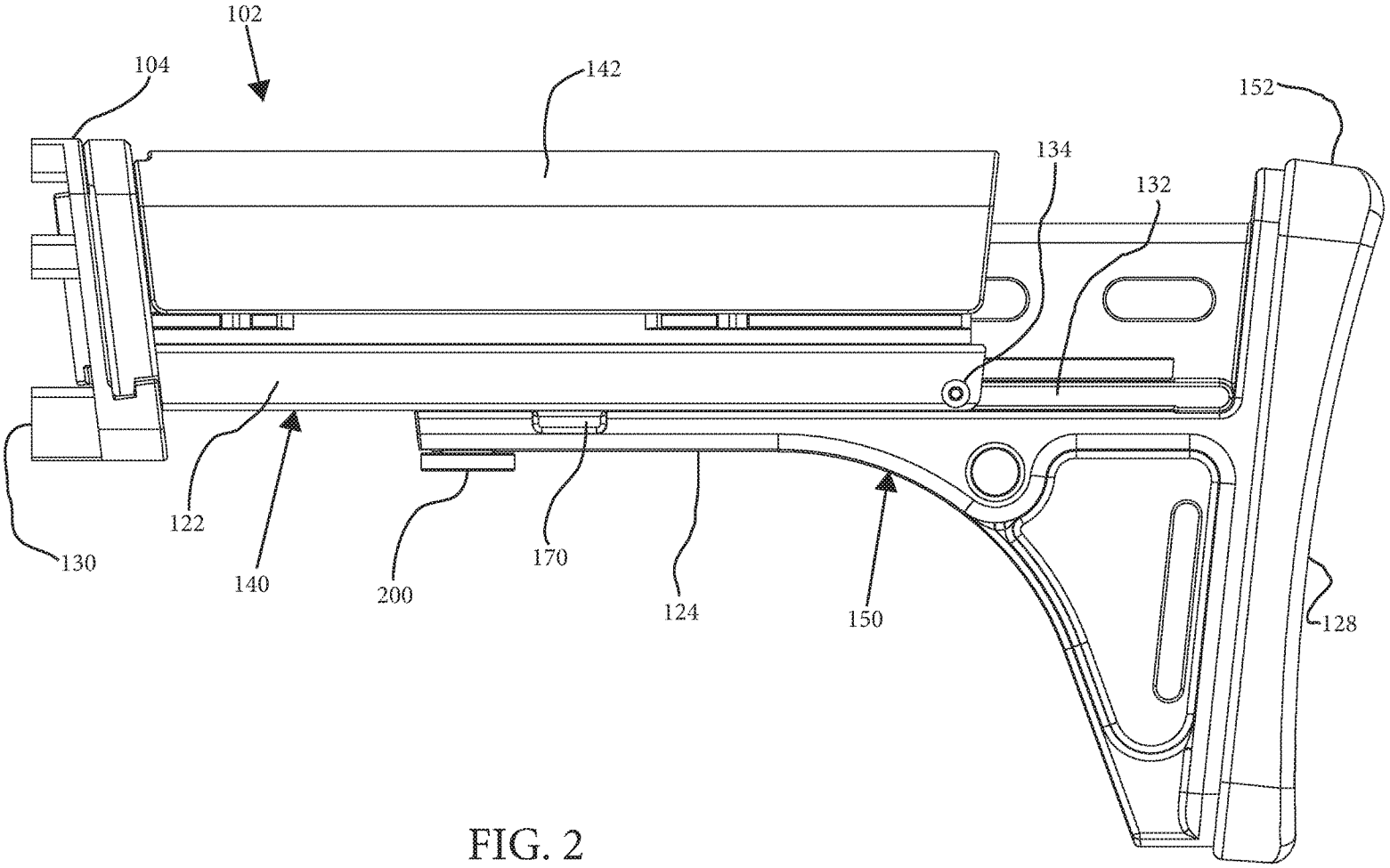
FIG. 2 illustrates a left side view of the adjustable stock of FIG. 1.

FIG. 2 is a left side view of the adjustable stock 102 of FIG. 1. As shown, a front side 130 of the stock 102 includes the attachment mount 104 attached to a fixed body 140. A cheek piece 142 is attached to the fixed body 140.

A moveable body 150 is slideably attached to the fixed body 140 and defines the butt 128. A groove 132 is disposed in the moveable body 150. A retaining pin 134 may be attached to the fixed body 140 and extended into the groove to permit the moveable body 150 to slide relative to the fixed body 140 while preventing the moveable body 150 from being fully detached from the fixed body 140.

A position selector 170 is shown extending from a first side 120 of the stock 102 and more specifically, the moveable body 150. A position retention device 200 is shown disposed on a bottom side 124 of the stock 102 and more specifically, the moveable body 150. A butt pad 152 may be attached to the moveable body 150 to provide cushioning between the butt 128 and a user's shoulder.

Figure 3:
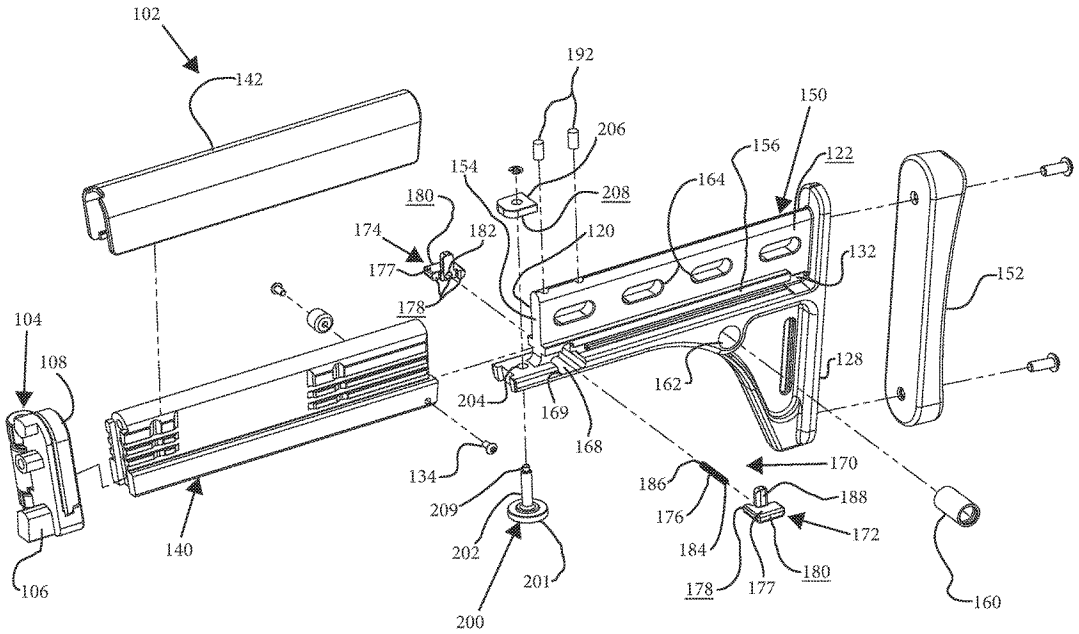
FIG. 3 illustrates an exploded orthogonal view of the adjustable stock of FIG. 1.

FIG. 3 is an exploded view of the adjustable stock 102 of FIG. 1. As shown the attachment mount 104 includes a firearm attachment plate 106 hingedly connected to a stock attachment plate 108. The stock attachment plate 108 may be attached to the fixed body 140 which is shaped to support a cheek piece 142. The fixed body 140 includes a sliding channel 144 shown in FIG. 4.

Figure 4:
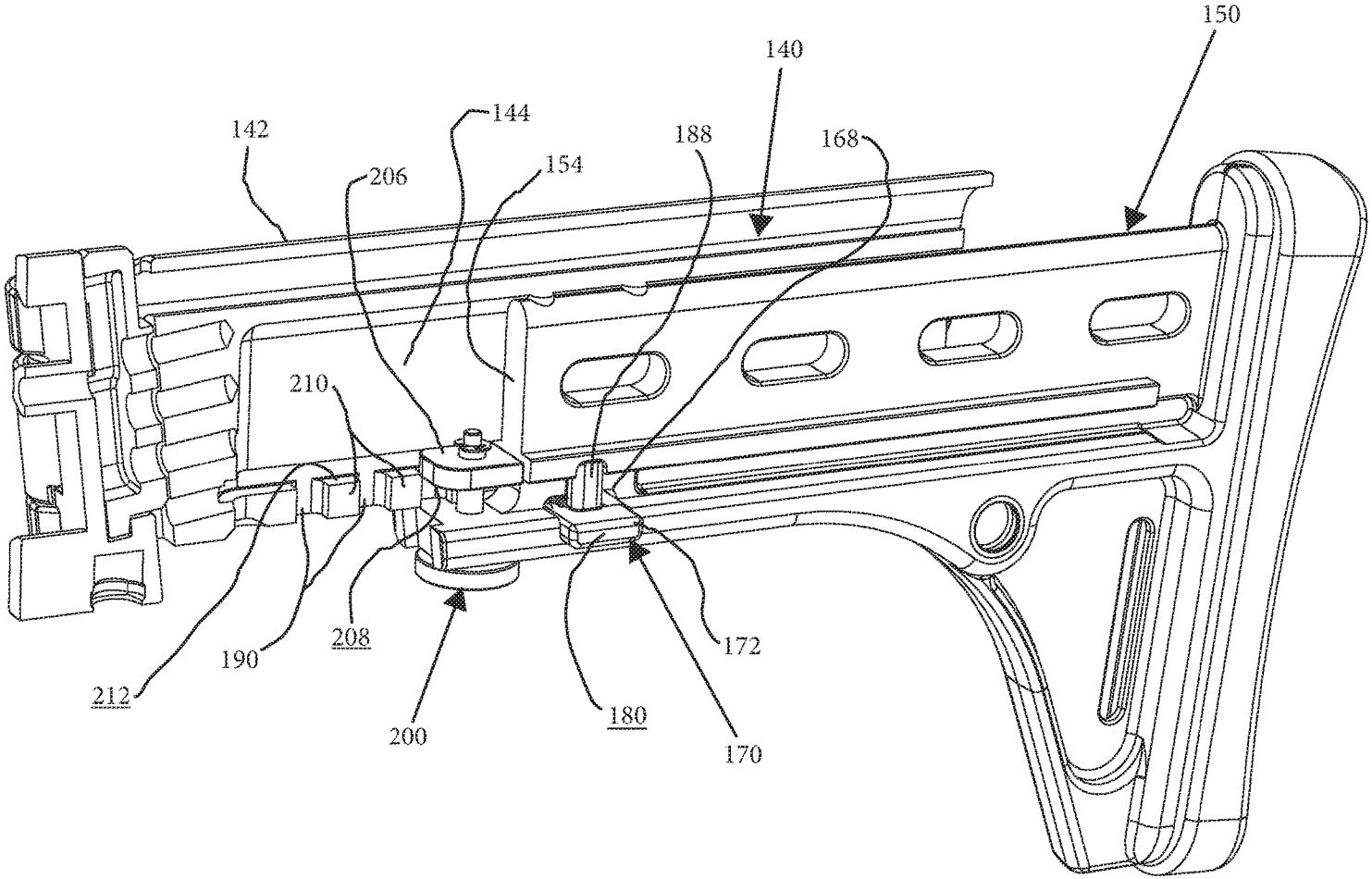
FIG. 4 illustrates a cut away orthogonal view of the adjustable stock of FIG. 1.

The moveable body 150 may be slideably connected to the fixed body 140 with the front end 154 and its rails 156 extending into the sliding channel 144 (shown in FIG. 4). The moveable body 150 includes the groove 132 into which the retaining pin 134 extends and prevents the moveable body 150 from being separated from the fixed body 140 during use.

A butt pad 152 may be attached to the butt 128 of the moveable body 150 and forms the rear side 126. Further, the moveable body 150 may include a quick detach mount 160 mounted in an orifice 162 of the moveable body 150. Lightening cuts 164 may be included in the moveable body 150.

The moveable body 150 includes a hole 168 horizontally extending between the first side 120 and the second side 122 and shaped to receive a position selector 170. The hole 168 has a first side opening 169 and a second side opening (not shown) disposed on the second side 122. The position selector 170 includes a first selector body 172, a second selector body 174, and a biasing device 176. The selector bodies 172 and 174 each include a body portion 177 having an abutment surface 178 opposite the engagement surface 180. Further, the selector bodies 172 and 174 each include an orifice 182 disposed in the abutment surface 178.

The orifices 182 are disposed to engage one of a first end 184 and a second end 186 of the biasing device 176. More specifically, the orifice 182 of the first selector body 172 is shaped to receive the first end 184 of the biasing device 176. Further, the orifice 182 of the second selector body 174 is shaped to receive the second end 186 of the biasing device 176.

The selector bodies 172 and 174 each include a protrusion 188 extending away from the body portion 177. As shown, the body portion 177 may be generally planar and the protrusion 188 may extend vertically from the horizontally planar body portion 177. From a side view of the selector bodies 172 and 174 and the hole 168, the selector bodies 172 and 174 and the hole 168 may have a profile of an upside down T. The protrusion 188 may be disposed in one of the plurality of locating slots 190 shown in FIG. 4 to retain the relative position of the moveable body 150 to the fixed body 140.

Bushings 192 are disposed between the moveable body 150 and the fixed body 140 to facilitate the sliding of the moveable body 150 within the fixed body 140 and minimize other movement between the moveable body 150 and the fixed body 140. As shown, the bushings 192 may be supported on top of the moveable body 150 and disposed proximate the front end 154 of the moveable body 150.

The moveable body 150 further includes a position retention device 200. The position retention device 200 may provide a second point of selective fixation between the fixed body 140 and the moveable body 150. The position retention device 200 may be disposed on a bottom side 124 of the adjustable stock 102 and more specifically, supported by the moveable body 150. Further, the position retention device 200 may be disposed at a front end 154 of the moveable body 150 opposite the butt 128.

The position retention device 200 may include an adjuster 201 attached to a shaft 202 extending through a retention aperture 204 of the moveable body 150. The shaft 202 may be attached to a locking member 206 having a locking surface 208 and as shown, may be shaped as a plate. The locking member 206 may be attached to an end 209 of the shaft 202. The locking surface 208 may include surface treatments and/or coatings to enhance the ability of the position retention device 200 to secure the moveable body 150 to the fixed body 140.

FIG. 4 shows a cut away orthogonal view of the adjustable stock 102 of FIG. 1. The fixed body 140 includes a sliding channel 144 and an array of locating slots 190 disposed in a first ridge 210. A second array of locating slots (not shown) in a second ridge (not shown) is disposed opposite the first array 190 about the sliding channel 144. The sliding channel 144 is sized to permit the front end 154 of the moveable body 150 to slide within the sliding channel 144 to change the relative position of the moveable body 150 to the fixed body 140.

As shown, the locking member 206 and its locking surface 208 of the position retention device 200 abuts a reciprocal lock surface 212 of the first ridge 210 of the fixed body 140 to lock the moveable body 150 to the fixed body 140. The shaft 202 and the retention aperture 204 may be threaded so that a user may twist the adjuster 201 to adjust the height of the locking member 206 and thus, the clamping force exerted by the locking surface 208 exerted on the reciprocal lock surface 212. Further, the adjuster 201 may be twisted to fully disengage the locking member 206 entirely from the reciprocal lock surface 212. Consequently during use, a user may unlock, or in other words, disengage the position retention device 200 and then, actuate the position selector 170 to allow the user to adjust the relative position of the moveable body 150 to the fixed body 140.

Also illustrated, position selector 170 is housed within the hole 168 with the engagement surface 180 extending from the hole 168. The protrusion 188 is also shown protruding from the hole 168 that permits the protrusion 188 to engage one of the second array of locating slots (not shown). When the engagement surface 180 is pressed, the protrusion 188 of the first selector 172 is disengaged from the one of the plurality of locating slots (not shown). Once the engagement surface 180 is released, the protrusion 188 of the first selector 172 is biased into one of the second array of locating slots (not shown).

Figure 5:
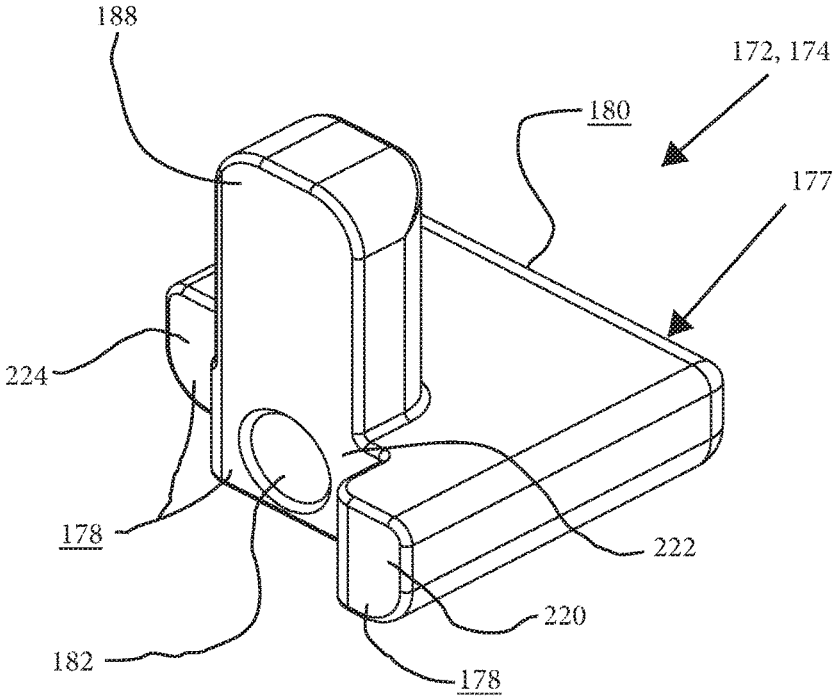
FIG. 5 illustrates an orthogonal view of a selector body shown in FIG. 3.
Figure 6:
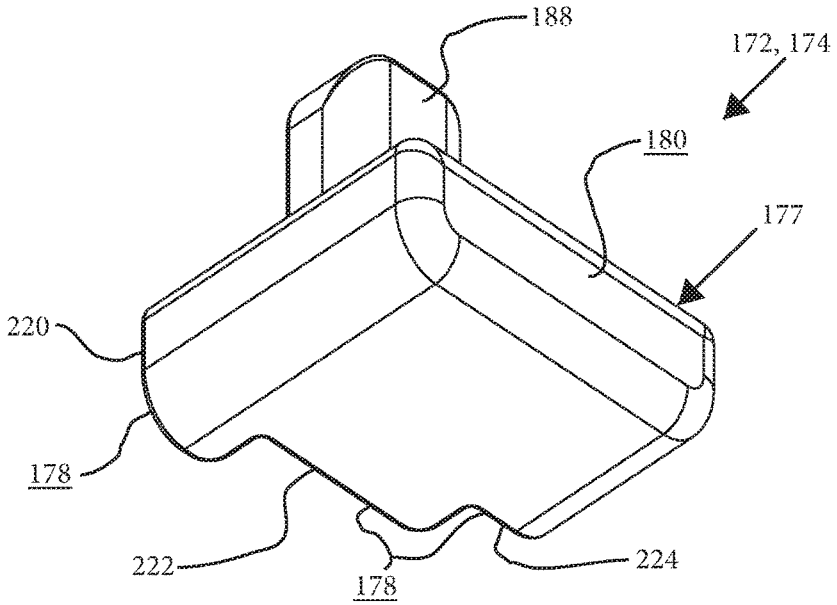
FIG. 6 illustrates an opposite orthogonal view of a selector body shown in FIG. 3.

FIGS. 5 and 6 illustrate orthogonal views of one of the selector bodies 172, 174 shown in FIG. 3. As shown, the selector body 172, 174 includes a body portion 177 having an abutment surface 178 opposite the engagement surface 180. Further, the selector body 172, 174 includes an orifice 182 disposed in the abutment surface 178. The abutment surface 178 may be stepped which may help assist the selector body 172 from binding with the reciprocal selector body when brought into engagement during actuation. The abutment surface 178 may include a first step 220, a second step 222, and a third step 224. The selector body 172, 174 includes a protrusion 188 extending away from the body portion 177.

INDUSTRIAL APPLICABILITY

In general, the invention disclosed herein concerns an adjustable stock for a firearm. The stock may include a front side, first side, a second side, a bottom side, and a rear side defining the butt of the stock. The stock may include a fixed body and an attachment mount permitting the stock to be attached to the firearm. The fixed body and the attachment mount may be integrally formed as a single structure with the attachment mount defining the front side of the stock. The attachment mount may optionally include a pivot connecting a firearm attachment plate and a stock attachment plate for side folding of the stock relative to the firearm.

The stock includes a moveable body slideably connected to the fixed body. The moveable body may be configured to slide within the fixed body. Specifically, the sliding channel is sized to permit the moveable body to slide within it to change the relative position of the moveable body to the fixed body. Alternatively, the moveable body may be configured to slide over the fixed body.

The stock may also include a separate cheek piece attached to one of the moveable body or the fixed body. The cheek piece has a cheek rest whose height may be adjusted relative to the one of the moveable body or the fixed body. Alternatively, a cheek rest may be integrally formed in one of the moveable body or the fixed body.

The stock further includes a position selector disposed to selectively fix the relative position of the moveable body to the fixed body. The position selector may be disposed on one of a first side or a bottom side to facilitate adjustment by a user. The position selector may be one of any known position selectors such as the latching mechanism disclosed in U.S. Pat. No. 7,762,018, the locking lever and locking pin of U.S. Pat. No. 7,162,822, or one of the adjustment mechanisms of US patent number application 20130180148.

Alternatively, the position selector may be of a novel design. Specifically, a hole may be defined in one of the fixed body and the moveable body for housing the position selector. The hole may have a first side opening and a second side opening disposed opposite the first side opening in the moveable body. The position selector includes a first selector body having a body portion shaped as a button having an engagement surface and a protrusion extending away from the body portion and a second selector body having a body portion shaped as a button having an engagement surface and a protrusion extending away from the body portion. The position selector further includes a biasing device having a first end and a second end and disposed between the first and second selector bodies to bias the first and second selector bodies apart. The biasing device may be a spring or an elastomeric polymer that when assembled in the stock, the biasing device is compressed to provide a biasing force biasing the first selector body and the second selector body apart and into engagement with the other of the fixed body or the moveable body to maintain the relative position of the moveable body to fixed body.

The engagement surface of the first selector body extends from the first side opening and the engagement surface of the second selector body extends from the second side opening. The first and second selector bodies may each include an abutment surface opposite the engagement surface. The first and second selector bodies may each include an orifice disposed in the abutment surface. The orifices may be shaped to receive a respective first or second end of the biasing device. In some configurations, the orifices may each have a depth that is at least equal to or greater than half of the length of a fully compressed biasing device. When the stock is assembled, the engagement surfaces extend outwardly from the moveable body and the fixed body. When the engagement surfaces are pressed by a user, the abutment surfaces of the first and second selector bodies may be brought into engagement and the biasing device compressed.

The abutment surfaces of the first and second selector bodies may be stepped. In one configuration, the abutment surfaces may each include a first surface and a parallel second surface. In another configuration, the abutment surfaces may each include a first surface, a second surface, and a third surface. The first surface, a second surface, and a third surface may be parallel or may be disposed at different angles to each other. When the engagement surfaces are fully pressed, the stepped abutment surfaces are brought into abutment. For example, the first surface of the first selector body may be brought into abutment with the third surface of second selector body. The second surface of the first selector body may be brought into abutment with the second surface of second selector body. Lastly, the third surface of the first selector body may be brought into abutment with the first surface of second selector body.

The other of the fixed body or the moveable body may include a first and second array of locating slots disposed opposite each other about a sliding channel shaped to receive the fixed body or the moveable body that supports the position selector. The protrusions of the first and second selector bodies may each engage one of the plurality of locating slots to selectively fix the relative position of the moveable body to the fixed body. When the engagement surfaces are pressed, the protrusions of the first and second selector bodies disengage from the plurality of locating slots to permit the relative position of the moveable body to the fixed body to be changed. To retain the moveable body in a desired position relative to the fixed body, the protrusions of the position selector may be disposed in the reciprocal locating slots defined in the other of the fixed body or the moveable body. When the engagement surfaces are pressed, the protrusions of the first and second selector bodies disengage from the locating slots and may be fully disposed within the hole.

This novel position selector provides an effective means for adjusting the stock to fit the size and body position of the user. In one configuration, the buttons are disposed on each side of the stock and proximate a bottom side of the stock so that a user shooting from a prone position can easily engage both buttons and slide the moveable body to a desired position relative to the fixed body of the stock. Once in the desired position, the user lets go of the buttons and the moveable body is gently slide into the closest locking channels to maintain the desired position relative to the fixed body.

Further, this design may have improved anti-binding capabilities of other position selectors due to its shape and stepped abutment surfaces. Additionally, this novel position selector is compact and disposed mostly in the interior of the stock and thus, is generally protected from dirt and debris that may interfere with the performance of other position selectors. Lastly, the position selector may require two buttons be engaged so that accidently bumping one button does not accidently disengage the position selector, which may potentially cause the firearm to not shoulder properly when in use.

In addition to a position selector, the stock may further include a position retention device providing a second point of selective fixation between the fixed body and the moveable body. This position retention device may be used with any type of position selector. The position retention device may be disposed on one of a first side or a bottom side of the stock, and more specifically, may be supported in one of the moveable body or the fixed body. In some embodiments, the position retention device may be supported by the same one of the moveable body or the fixed body as the position selector.

The position retention device includes a locking surface that selectively abuts a reciprocal lock surface of the other of the fixed body or the moveable body to lock the moveable body to the fixed body. The moveable body or the fixed body includes a retention aperture and the position retention device includes an adjuster and a shaft extending from the adjuster through the retention aperture. The position retention device further includes a locking member comprising the locking surface attached to an end of the shaft. The locking member may be a plate or any other shape that includes the locking surface. In some configurations, the position retention device may be disposed at a front end of the moveable body opposite the butt. Further, the adjuster of the position retention device may be disposed proximate the buttons of the position selector on the bottom side of the stock.

The other of the fixed body or the moveable body includes a reciprocal lock surface. In some configurations, the reciprocal lock surface may be a surface of ridges formed in the other of the fixed body or the moveable body. The ridges may also define the first and second arrays of the plurality of locating slots. Further in some configurations, the fixed body may include an internal sliding channel having a bottom surface and the bottom surface may include the reciprocal lock surface. Thus, where the moveable body is disposed in the sliding channel of the fixed body, the front end of the moveable body is disposed in the sliding channel with the position retention device supported by the moveable body and engaging the reciprocal lock surface.

The locking surface and/or the reciprocal locking surface may have a surface treatment to increase the friction between the locking surface and the reciprocal locking surface when the position retention device is engaged. In some configurations, the locking surface and/or the reciprocal locking surface may be smooth, knurled or have some other roughening surface treatment. Alternatively, the locking surface and/or the reciprocal locking surface may have a high friction material coating, such as an elastomer, rubber, or plasma or electroplated carbide coating.

In use, a user would select the desired position and engage the position selector. Then, the user would use the adjuster to engage the position retention device and lock the moveable body to the fixed body to provide a rigid adjustable stock. This position retention device provides the benefit of allowing a user to remove the slop normally found in adjustable stocks. Removal of the slop may provide a highly stable firing platform to improve the repeatability and accuracy of the overall firearm, especially in long distance shooting applications.

What is claimed is:

1. An adjustable stock for a firearm, comprising:

a fixed body attachable to the firearm;

a moveable body slideably connected to the fixed body, the moveable body including a butt of the stock;

a hole defined in one of the fixed body and the moveable body, the hole having a first side opening and a second side opening disposed opposite the first side opening;

a plurality of locating slots defined in the other of the fixed body and the moveable body;

a position selector including:

a first selector body having a body portion shaped as a button having an engagement surface and a protrusion extending away from the body portion;

a second selector body having a body portion shaped as a button having an engagement surface and a protrusion extending away from the body portion;

a biasing device disposed between the first and second selector bodies to bias the first and second selector bodies apart, wherein the position selector is disposed in the hole, wherein the engagement surface of the first selector body extends from the first side opening and the engagement surface of the second selector body extends from the second side opening, wherein one of the protrusions of the first and second selector bodies engage one of the plurality of locating slots to selectively fix the relative position of the moveable body to the fixed body;

wherein the abutment surfaces of the first and second selector bodies are stepped, wherein when the engagement surfaces are fully pressed, the stepped abutment surfaces are brought into abutment.

2. The stock of claim 1, wherein the biasing device is a spring having a first end and a second end, wherein the first end abuts the first selector body and the second end abuts the second selector body.

3. The stock of claim 2, wherein the first selector body includes an orifice disposed in the abutment surface, wherein the orifice is shaped to receive the first end of the spring, wherein the second selector body includes an orifice disposed in the abutment surface, wherein the orifice is shaped to receive the second end of the spring.

4. The stock of claim 1, wherein the biasing device is an elastomeric polymer, having a first end and a second end, wherein the first end abuts the first selector body and the second end abuts the second selector body.

5. The stock of claim 4, wherein the first selector body includes an orifice disposed in the abutment surface, wherein the orifice is shaped to receive the first end of the elastomeric polymer, wherein the second selector body includes an orifice disposed in the abutment surface, wherein the orifice is shaped to receive the second end of the elastomeric polymer.

6. The stock of claim 1, wherein when the engagement surfaces are pressed, the one of the protrusions of the first and second selector bodies disengages from the one of the plurality of locating slots to permit the relative position of the moveable body to the fixed body to be changed.

7. The stock of claim 1, wherein when the engagement surfaces are pressed, the protrusions of the first and second selector bodies are fully disposed within the hole.

8. The stock of claim 1, wherein the hole is defined in the moveable body and the plurality of locating slots are defined in the fixed body.

9. The stock of claim 8, wherein the plurality of locating slots include a first and second array of locating slots disposed opposite each other about a sliding channel.

10. The stock of claim 8, wherein the sliding channel is sized to permit the moveable body to slide within said sliding channel to change the relative position of the moveable body to the fixed body.

11. An adjustable stock for a firearm, comprising:

a fixed body attachable to the firearm;

a moveable body slideably connected to the fixed body, the moveable body including a butt of the stock;

a hole defined in one of the fixed body and the moveable body, the hole having a first side opening and a second side opening disposed opposite the first side opening;

a plurality of locating slots defined in the other of the fixed body and the moveable body;

a position selector including:

a first selector body having a body portion shaped as a button having an engagement surface and a protrusion extending away from the body portion;

a second selector body having a body portion shaped as a button having an engagement surface and a protrusion extending away from the body portion; and a biasing device disposed between the first and second selector bodies to bias the first and second selector bodies apart, wherein the position selector is disposed in the hole, wherein the engagement surface of the first selector body extends from the first side opening and the engagement surface of the second selector body extends from the second side opening, wherein one of the protrusions of the first and second selector bodies engage one of the plurality of locating slots to selectively fix the relative position of the moveable body to the fixed body, wherein when the engagement surfaces are pressed, the protrusions of the first and second selector bodies are fully disposed within the hole, wherein the first selector body includes an abutment surface opposite the engagement surface and the second selector body includes an abutment surface opposite the engagement surface; and wherein the abutment surfaces of the first and second selector bodies are stepped, wherein when the engagement surfaces are fully pressed, the stepped abutment surfaces are brought into abutment.

12. The stock of claim 11, wherein the biasing device has a first end and a second end, wherein the first end abuts the first selector body and the second end abuts the second selector body, wherein the first selector body includes an orifice disposed in the abutment surface, wherein the orifice is shaped to receive the first end of the biasing device, wherein the second selector body includes an orifice disposed in the abutment surface, wherein the orifice is shaped to receive the second end of the biasing device.

13. The stock of claim 12, wherein the biasing device is an elastomeric polymer.

14. The stock of claim 12, wherein the biasing device is a spring.

15. The stock of claim 11, wherein when the engagement surfaces are pressed, the one of the protrusions of the first and second selector bodies disengages from the one of the plurality of locating slots to permit the relative position of the moveable body to the fixed body to be changed.

16. The stock of claim 11, wherein the hole is defined in the moveable body and the plurality of locating slots are defined in the fixed body.

17. The stock of claim 16, wherein the plurality of locating slots include a first and second array of locating slots disposed opposite each other about a sliding channel, wherein the sliding channel is sized to permit the moveable body to slide within it to change the relative position of the moveable body to the fixed body.

* * * * *